US006361478B1

(12) United States Patent
Giancaspro

(10) Patent No.: US 6,361,478 B1
(45) Date of Patent: Mar. 26, 2002

(54) TRAINING HARNESS

(76) Inventor: Giovanna Giancaspro, 1980 Sauve St. East, Montreal, Quebec (CA), H2B 1A4

( * ) Notice: Subject to any disclaimer, the term of this patent is extended or adjusted under 35 U.S.C. 154(b) by 0 days.

(21) Appl. No.: 09/444,644

(22) Filed: Nov. 22, 1999

Related U.S. Application Data

(60) Provisional application No. 60/109,492, filed on Nov. 23, 1998.

(51) Int. Cl.[7] ..... A63B 22/00

(52) U.S. Cl. ..... 482/69; 128/875; 434/255

(58) Field of Search ..... 482/69, 24, 139; 128/845, 846, 869, 870, 874, 875; 602/4; 224/158, 159, 160; 119/770, 857; 434/247, 255

(56) References Cited

U.S. PATENT DOCUMENTS 175,573 A * 2/1876 Smith ..... 482/69
339,650 A * 4/1886 Hill
1,193,374 A * 8/1916 Gilliam
4,907,972 A * 3/1990 Marolda ..... 434/255
4,922,860 A * 5/1990 Hutchings ..... 119/96
5,086,762 A * 2/1992 Chee ..... 602/4
5,120,287 A * 6/1992 Brown et al. ..... 482/69
5,356,355 A * 10/1994 Campbell ..... 482/43
5,388,551 A * 2/1995 Martusciello ..... 119/770
5,435,272 A * 7/1995 Epstein ..... 119/770
5,498,219 A * 3/1996 Soufi ..... 482/69

* cited by examiner

*Primary Examiner*—Denise Pothier
(74) *Attorney, Agent, or Firm*—Eric Fincham

(57) ABSTRACT

A harness suitable for teaching a sports activity such as skiing or skating, the harness having a body strap which encircles the body of a child, first and second shoulder straps extending between front and rear portions of the body strap, and first and second support handles extending upwardly from the shoulder straps, first and second user handles extending from the harness for grapsing by the child.

7 Claims, 3 Drawing Sheets

TRAINING HARNESS

This application claims benefit of Prov. No. 60/109,492 filed Nov. 23, 1998.

FIELD OF THE INVENTION

The present invention relates to a harness and more particularly, relates to a training harness.

BACKGROUND OF THE INVENTION

Learning some sports becomes somewhat difficult due to the fear of injury. Such sports would include skiing, in-line skating, ice skating, etc. To a degree, one must learn balance and coordination skills which are difficult to initially achieve. As a result, the learner will fall and frequently this will instill a fear in the learner which makes it even more difficult to learn.

During the learning process, and particularly in the case of a child, the parent or other instructor will hold on to the child to permit the child to learn to balance while acquiring the required muscle coordination and balance.

However, the holding on to the child often causes the learner to modify a natural body alignment which is required for adequate balance and muscle coordination. Furthermore, it is frequently difficult for the parent or instructor to adequately hold on to the learner.

These problems have been recognized in the past and, various types of devices have been proposed to aid skaters during their learning process. For example, U.S. Pat. No. 4,922,860 issued May 8, 1990 discloses a harness having generally orthogonal strap means adapted to fit around and conform to the body of the wearer. Integral handle means extend from the harness and are adapted to be held by a person for supporting the wearer. The strap means preferably includes a combination of two generally vertical straps which criss-cross the wearer and at least one cooperating chest band which supports and circumscribes the wearer's chest. The support straps each have an extension which serves as a handle means.

Although useful in supporting the learning skater without having the latter directly and unergonomically holding on to a supporting structure or person, the harness still suffers from drawbacks. One of the main drawbacks associated with this prior art harness relates to the fact that the wearer is in contact with the strap only through the body-contacting portion of the latter. The wearer thus experiences the sensation of being strapped-in much like a package suspended from handles. This sensation can rapidly become frustrating. Furthermore, contact of the straps with the body limited to the chest and crotch areas fails to provide adequate sensory input to the wearer as to the type of balancing assistance provided by the individual holding on to the handle portion of the harness.

SUMMARY OF THE INVENTION

It is therefore an object of the present invention to provide an improved training harness for skaters different sports.

According to one aspect of the present invention, there is provided a harness suitable for teaching a sports activity to a child, the harness comprising, a body engaging portion designed to encircle a child's body, a first set of support handle means extending from the body engaging portion and designed to be grasped by a supporting individual, and a second set of user handle sections extending from the body engaging portion to be grasped by the child.

In a further aspect of the present invention, there is provided a harness suitable for teaching a sports activity to a child a harness suitable for teaching a sports activity to a child, the harness comprising, a body strap designed to encircle the body of the child; first and second shoulder strap means each extending between front and rear portions of the body straps, first and second support handle means each extending from a respective one of the shoulder straps for grasping by a supporting individual, and first and second user handle means each extending from the harness for grasping by the child.

Advantages of the present invention include the fact that the proposed training harness is specifically adapted to be used to support and assist a child or disabled individual during training in activities requiring practice and motor coordination such as walking, skating, skiing or the like. Also, the proposed learning harness provides not only a torso engaging section for securing to the wearer and a first support handle means for allowing an individual to support the wearer but also a user handle means for allowing the wearer to hold on to the latter. The user handle means is adapted to allow the wearer to selectively reduce the tension in the torso engaging section of the harness. Also, the user handle means not only provides for a subjective sense of security but also allows the wearer to get a feel of the type of supporting effort provided by the supporting individual since the user handle means are preferably mechanically coupled to the first support handle means. Hence, the wearer obtains a manual feedback on the coordination efforts provided by the supporting individual. This type of feedback, in turn, improves the learning process.

Furthermore, the harness has a torso engaging section designed with optimal characteristics so as to improve the comfort of the wearer. Still further, the proposed harness is specifically designed so as to be customized to wearers of various sizes and configurations. Also, the harness is specifically configured so as to be manufacturable using conventional forms of manufacturing thus providing a harness which will be economically feasible, long-lasting and relatively trouble free in operation.

BRIEF DESCRIPTION OF THE DRAWINGS

Having thus generally described the invention, reference will now be made to the accompanying the drawings illustrating embodiments thereof, in which.

DESCRIPTION OF THE PREFERRED EMBODIMENTS

Figure 1:
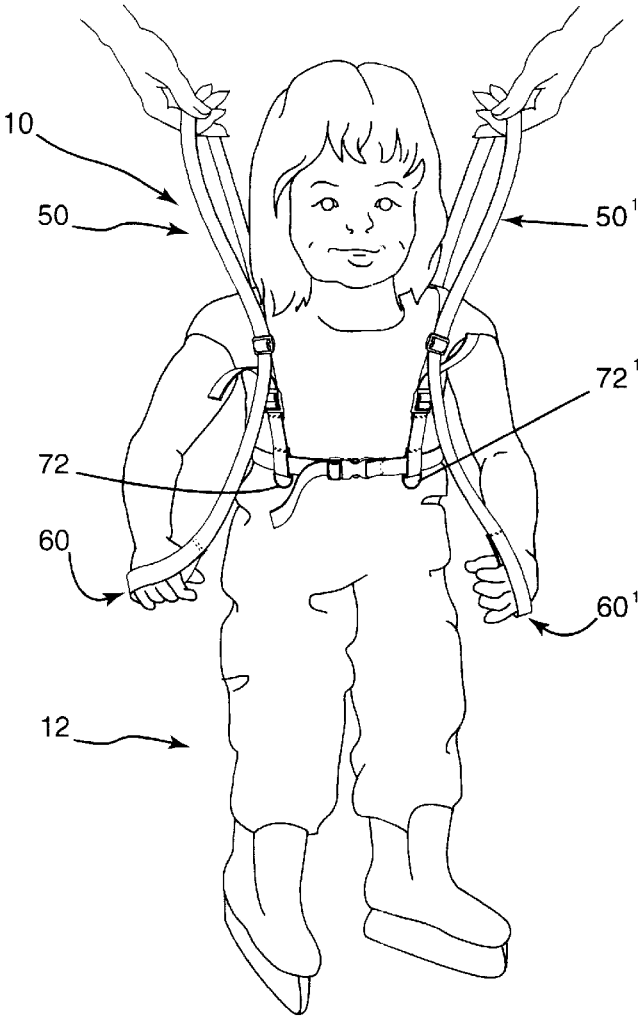
FIG. 1 is a front perspective view illustrating a training harness according to one embodiment of the present invention, the harness being worn by a child and supported by the hands of an instructor.
Figure 2:
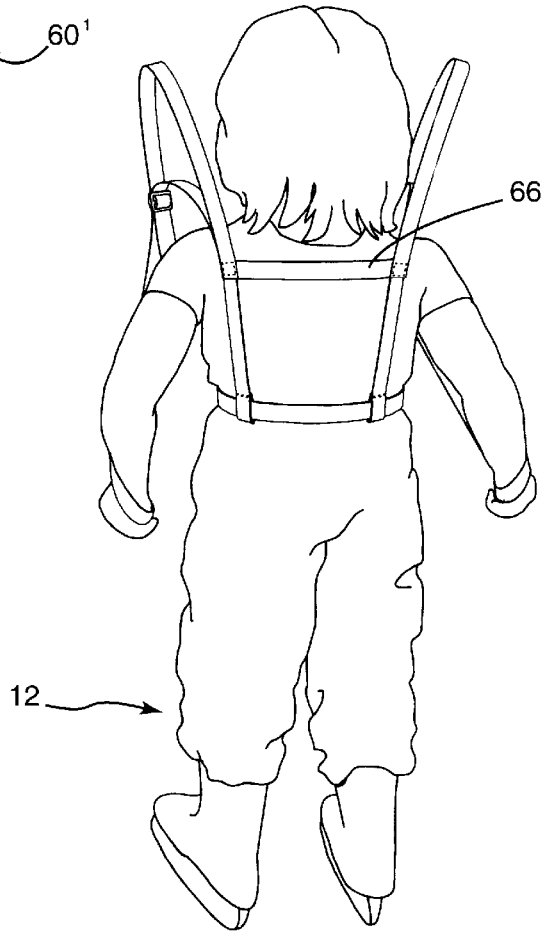
FIG. 2 is a rear perspective view illustrating the harness of FIG. 1 being worn by a child.

Referring to the drawings in a greater detailed and by reference characters thereto, there is shown in FIGS. 1 and 2 a harness generally designated by reference numeral 10 being worn by a child 12.

Figure 3:
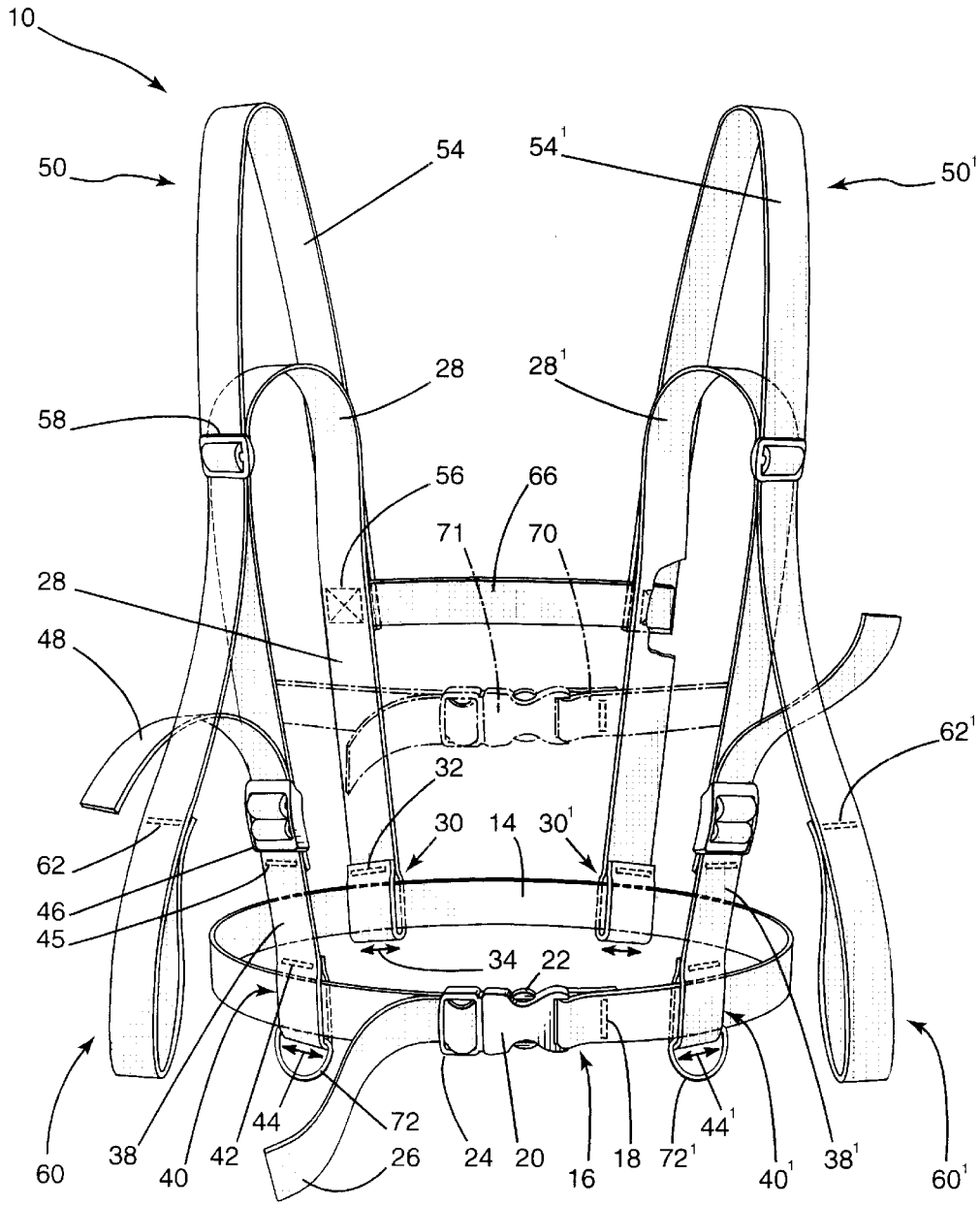
FIG. 3 is a perspective view of the harness of FIGS. 1 and 2.
Figure 4:
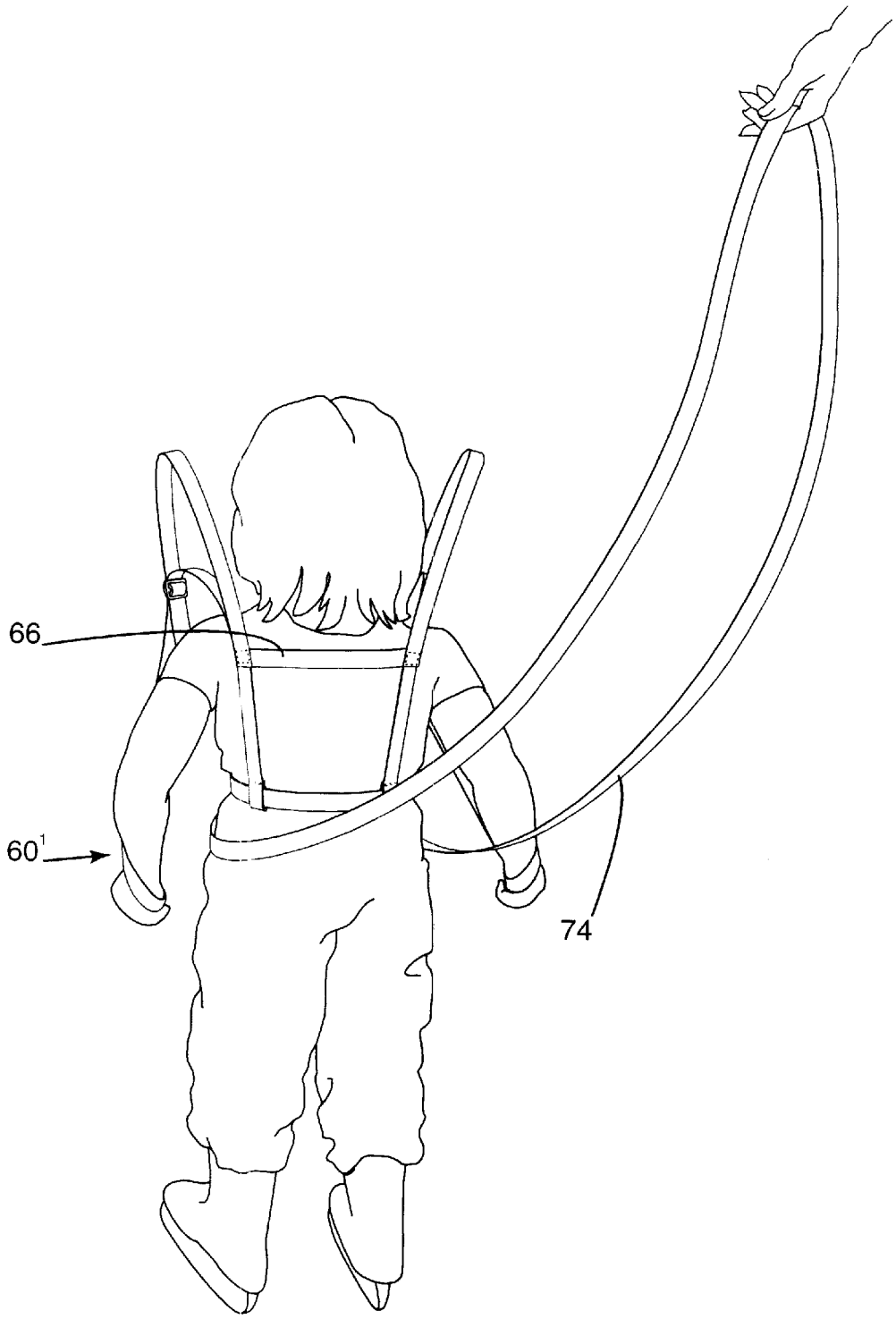
FIG. 4 is a rear perspective view of a further embodiment of a harness according to the present invention.

As best seen in FIG. 3, harness 10 includes a body strap 14 designed to encircle the torso of a child. Body strap 14 has, at one end thereof, a loop 16 formed by means of a stitching 18. Loop 16 is engaged about a first fastening component 20.

A second fastening component 22 is designed to cooperatively engage with first fastening component 20 in a known manner. A buckle 24 forms a portion of second fastening component 22 and provides for means of adjusting the length of body strap 14 required for encircling the body torso—i.e. strap end 26 can be pulled on to tighten body strap 14 in a known manner.

Harness 10 also includes a first segment 28 of a first shoulder strap. At one end thereof, first segment 28 is secured to body strap 14 by a loop 30 formed by stitching 32. The attachment is sufficiently loose that first segment 28 can be moved horizontally as indicated by arrow 34.

A second segment 38 of the shoulder strap has a first end engaged about body strap 14 by means of a loop 40 formed with stitching 42. Again, the arrangement is such that second segment 38 can move along body strap 14 as indicated by arrow 44.

At its other end, second segment 38 is secured to a buckle 46 by means of stitching 45.

As may be seen in FIG. 3, the arrangement is such that distal end 48 of first segment 28 is threaded through buckle 46 in a known matter and thus the length of the shoulder strap may be adjusted.

A handle strap 54 has a first end secured to a rear section of first segment 28 by means of stitching 56. Handle strap 54 passes intermediately through an adjustment buckle 58 which is amounted on front section of first segment 28 and has a user handle segment 60 forming a loop at a distal end thereof by means of stitching 62. A support handle section 50 is forming a loop between the point of stitching 56 and adjustment buckle 58. Optionally, handle strap 54 may be removably attached to first segment 28.

There is also provided a second shoulder strap and handle strap which are identical to those already described and thus, will not be described in detail herein. Similar reference numerals with a ' are utilized for similar components.

In the embodiment of FIG. 3, a rear cross strap 66 extends between first segments 28, 28'.

In use, harness 10 is snugly fastened about the wearer's body with shoulder straps 28, 38 and 28', 38' tightened suitably against the wearer's shoulder and the body strap 14 positioned generally horizontally in a snug fashion around the wearer's waist just above the hips. This position will support the child when the child is held by support handle sections 50, 50' in a generally vertical position above the child's center of gravity and inhibit unbalanced movement. Rear cross strap 66 restrains the shoulder straps 28, 38 and 28', 38'from slipping off the child's shoulder.

It will also be noted that the support handle section 50 allows the supporting individual or teacher to support the child 12 through the harness 10 while providing a user handle section 60, 60' to allow the child to hold on to. Grasping of user handle sections 60, 60' provides a feeling of security to the child 12 while allowing movement of the child's arm and without compromising the child's coordination and body posture. Furthermore, since user handle sections 60 are mechanically coupled to handle sections 50, the child 12 is provided with a sensory input of the supporting gestures of the teacher or supporting individual.

In an optional arrangement, and one which would be particularly suitable for skiing, there is provided a front transverse strap 70 having adjustable buckle 71. D rings 72 and 72' are provided at loops 40, 40'. They may be utilized for receiving a restraining strap 74 which has hooks for attachment to the D rings 72.

The straps may be made of any suitable material and in one preferred embodiment, would include a woven polypropylene webbing. Similarly, the fasteners and buckles may be formed of plastic and/or metal as desired.

It will be understood that the above described embodiments are for purposes of illustration only and that changes or modifications may be made thereto without departing from the spirit in scope of the invention.

I claim:

1. A training harness for teaching sports activities to a child, said training harness comprising:

a torso-encircling strap designed to encircle the body of the child;

first and second shoulder straps each extending between and terminating at front and rear portions of said torso encircling strap;

a first single, continuous strap having a first end, an intermediate portion and a distal end, the first end of the first continuous strap attached to a rear section of the first shoulder strap and the intermediate portion of the first continuous strap adjustably attached to a front section of the first shoulder strap, wherein the attachment of the first end and the intermediate portion of the first continuous strap to the first shoulder strap form a first support handle loop for grasping by a supporting individual and wherein the distal end of the first continuous strap terminates and attaches to a portion of the first continuous strap forming a first user handle loop for grasping by the child; and a second single, continuous strap having a first end, an intermediate portion and a distal end, the first end of the second continuous strap attached to a rear section of the second shoulder strap and the intermediate portion of the second continuous strap adjustably attached to a front section of the second shoulder strap, wherein the attachment of the first end and the intermediate portion of the second continuous strap to the second shoulder strap form a second support handle loop for grasping by a supporting individual and wherein the distal end of the second continuous strap terminates and attaches to a portion of the second continuous strap forming a second user handle loop for grasping by the child.

2. The harness of claim 1 further including a rear cross strap extending between said first and second shoulder straps, said rear cross strap being located about said torso-encircling strap.

3. The harness of claim 2 further including a front cross strap extending between said first and second shoulder straps.

4. The harness of claim 2 wherein said torso-encircling strap is adjustable in length.

5. The harness of claim 1 further including a retainer strap, said retainer strap being secured at first and second points on the front portion of said torso-encircling strap.

6. The harness of claim 1 wherein said shoulder straps are adjustable in length.

7. The harness of claim 1 wherein said torso-encircling strap and said shoulder straps are formed of a woven material.

* * * * *